United States Patent [19]

Saito

[11] 4,287,384

[45] Sep. 1, 1981

[54] PHASE STABILIZATION TYPE COAXIAL CABLE

[75] Inventor: Yasunori Saito, Yokohama, Japan

[73] Assignee: Sumitomo Electric Industries, Ltd., Osaka, Japan

[21] Appl. No.: 114,173

[22] Filed: Jan. 22, 1980

[30] Foreign Application Priority Data

Feb. 23, 1979 [JP] Japan ..... 54/21003

[51] Int. Cl.[3] ..... H01B 11/18

[52] U.S. Cl. ..... 174/29; 333/243

[58] Field of Search ..... 174/28, 29; 333/243, 333/244; 264/174

[56] References Cited

U.S. PATENT DOCUMENTS 4,181,486 1/1980 Saito ..... 264/174

FOREIGN PATENT DOCUMENTS 2820987 11/1978 Fed. Rep. of Germany ..... 264/174

733178 7/1955 United Kingdom ..... 174/29

1030134 5/1966 United Kingdom ..... 174/29

OTHER PUBLICATIONS

Merrell, E. J. et al., "Styroflex Aluminum-Sheathed Air-Dielectric Cable", *AIEE Transactions,* Jan. 1957, pp. 669-674.

*Primary Examiner*—Laramie E. Askin

*Attorney, Agent, or Firm*—Sughrue, Mion, Zinn, Macpeak and Seas

[57] ABSTRACT

An air dielectric coaxial cable in which variations in phase characteristics due to variations in ambient temperature are minimized. An insulator is formed by welding a spiral rib which is in contact along one edge thereof with the outer wall of the inner conductor to an outer pipe of the same material. The outer conductor is provided in close contact with the outer wall of the insulating pipe. The space factor of the insulator is set between predetermined limits in accordance with a disclosed technique.

4 Claims, 2 Drawing Figures

PHASE STABILIZATION TYPE COAXIAL CABLE

BACKGROUND OF THE INVENTION

The instant invention relates to an air dielectric coaxial cable in which variations in phase characteristics due to variations in ambient temperature are minimized.

Recently, observation systems in which are a large antenna is formed by connecting with coaxial cables a number of antenna elements which are spaced apart from one another on the ground have been employed in specific fields such as radio astronomy in order to intercept radio waves from space for instance. In such systems, reception of signals is carried out for a long observation period such as over several months therefore making it a requirement that the electrical length of the system be constant. In order to meet this requirement, a technique for maintaining the entire system at a constant temperature or a technique for providing a phase control device to compensate for variations of the electrical length of the system due to variations of the ambient temperature in the system has been employed. However, such techniques are disadvantageous in that they are expensive to implement and it is difficult with these techniques to satisfactorily control the ambient temperature.

SUMMARY OF THE INVENTION

Accordingly, an object of this invention is to provide a phase stabilization type coaxial cable for such an antenna system as described above, which has, in accordance with the invention, a structure designed to greatly reduce phase variation due to temperature variation, thus eliminating intricate operations such as temperature control and phase control as described above.

In accordance with this and other objects of the invention there is provided an air dielectric coaxial cable having an inner conductor, an outer conductor, and an insulator disposed between the inner and outer conductors in which the space factor of the insulator falls within disclosed limits determined from the cross-sectional areas of the inner and outer conductors, the Young's modulus of the material forming the inner and outer conductors, the coefficients of linear expansion of the material of the inner and outer conductors, the outside and inside diameters of the inner and outer conductors, respectively, and the dielectric constant of the insulator. The insulator is preferably formed by welding a spiral rib provided on the outer wall of the inner conductor to an outer pipe of the same material which covers the spiral rib. The outer conductor is provided on the outer wall of the outer pipe in such a manner that the inner wall of the outer conductor is in close contact with the outer wall of the outer pipe.

The foregoing object and other objects as well as the characteristic features of the present invention will become more apparent from the following detailed description and the appended claims when read in conjunction with the accompanying drawings.

DETAILED DESCRIPTION OF THE INVENTION

Figure 1:
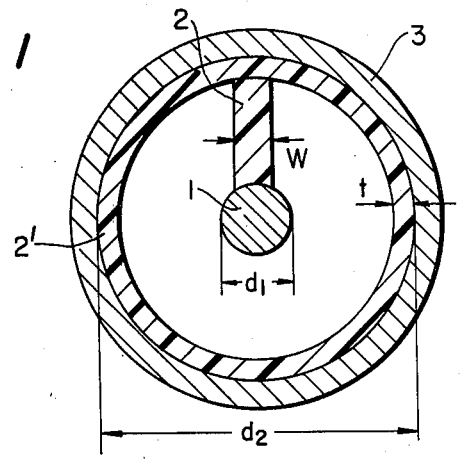
FIG. 1 is a cross-sectional view of a preferred embodiment of a phase stabilization type coaxial cable according to the invention.

First, the principle of phase stabilization according to this invention will be described.

The phase temperature coefficient $k_\beta$ of a coaxial cable having a length l is the sum of the temperature coefficient of a phase constant and the temperature coefficient of a cable length as is apparent from the following Equation 1:

$$k_\beta = \frac{1}{\beta l}\frac{\partial \beta l}{\partial T} = \frac{1}{\beta}\frac{\partial \beta}{\partial T} + \frac{1}{l}\frac{\partial l}{\partial T} \tag{1}$$

In general, the coefficient of thermal expansion of an insulator is larger than that of a conductor. The first term of the right side Equation 1, the temperature coefficient of the phase constant, is for insulators approximately equal to one-half the temperature coefficient of effective dielectric constant. In the case of an air dielectric coaxial cable, the first term can be evaluated by the following Equation 2:

$$\frac{1}{\beta}\frac{\partial \beta}{\partial T} \approx \frac{1}{2}\frac{1}{\epsilon}\frac{\partial \epsilon}{\partial T} \approx \frac{\epsilon_0}{2} \times \frac{R}{1 + R(\epsilon_0 - 1)}\left[\frac{1}{\epsilon_0}\frac{\partial \epsilon_0}{\partial T} + \left(1 - \frac{1}{\epsilon_0}\right)\left(\alpha_0 - \frac{d_1\alpha_1 + d_2\alpha_2}{d_1 + d_2}\right)\right], \tag{2}$$

where R is the space factor of the insulator, $\epsilon_0$ is the inherent dielectric constant of the insulating material $\alpha_0$ is the coefficient of linear expansion thereof, and $\alpha_1$ and $\alpha_2$ are the coefficients of linear expansion of the inner and outer conductors.

It is well known in the art that the second term of the right side of Equation 1 can be represented by the following Equation 3 in the case where the inner and outer conductors are rigidly secured to the insulator:

$$\frac{1}{l}\frac{\partial l}{\partial T} \approx \frac{S_1E_1\alpha_1 + S_2E_2\alpha_2}{S_1E_1 + S_2E_2}, \tag{3}$$

where $S_1$ are $S_2$ are the cross-sectional areas of the inner and outer conductors, respectively, $E_1$ and $E_2$ are the Young's moduli of the materials of the inner and outer conductors, respectively, and $\alpha_1$ and $\alpha_2$ are the coefficients of the linear expansion of the inner and outer conductors.

From Equations 1 through 3 the phase temperature coefficient of the air dielectric coaxial cable is then:

$$k_\beta \approx \frac{\epsilon_0}{2} \times \frac{R}{1 + R(\epsilon_0 - 1)}\left\{\frac{1}{\epsilon_0}\frac{\partial \epsilon_0}{\partial T} + \left(1 - \frac{1}{\epsilon_0}\right)\left(\alpha_0 - \frac{d_1\alpha_1 + d_2\alpha_2}{d_1 + d_2}\right)\right\} + \frac{S_1E_1\alpha_1 + S_2E_2\alpha_2}{S_1E_1 + S_2E_2} \tag{4}$$

From this equation it may be seen that a phase stabilization type coaxial cable can be realized by selecting the space factor R of the insulator so that the phase temperature coefficient $k_\beta$ given by Equation 4 above is zero. However, since the dielectric constant $\epsilon_0$ of the insulating material and its temperature coefficient $$\frac{1}{\epsilon_0}\frac{\partial\epsilon_0}{\partial T}$$

are, in general, functions of temperature T, it is necessary to select the space factor R of the insulator under the condition that these constants with respect to use temperature have otherwise been determined.

In Equation 4, $k_\beta$ is as a practical matter approximately equal to zero due to the following reason. The dielectric constant temperature coefficient $$\frac{1}{\epsilon_0}\frac{\partial\epsilon_0}{\partial T}$$

of the insulating material is negative in the range of ordinary use temperature −50° to +100° C. with the absolute value thereof slightly larger than the coefficient of linear expansion $\alpha_0$ (being larger by one order than $\alpha_1$ and $\alpha_2$). Therefore, the first term on the right side of Equation 4 is generally negative. On the other hand, the second term of the right side of Equation 4 is positive, the coefficient of linear expansion of metal being, in general, positive. Accordingly, the phase temperature coefficent $k_\beta$ in Equation 4 can be made zero by suitably selecting the value of the space factor of the insulator.

Furthermore, in general, these factors in Equation 4 can be established completely independently of the impedance of a cable. Therefore, an impedance given by the following Equation 5 can be set to a specified value by designing the cable so that the ratio of the inside diameter $d_2$ of the outer conductor to the outside diameter $d_1$ of the inner conductor has a suitable value:

$$Z_0 = \frac{60}{\sqrt{\epsilon}}\ln\frac{d_2}{d_1} \tag{5}$$

The present invention provides a phase stabilization type coaxial cable according to the above-described principle in which the space factor of the insulator is so set that under the conditions that the materials of the cable, the transmission characteristics of the cable, specifically the attenuation constant and characteristic impedance, and the ambient temperature of the cable in use are specified, the absolute value of the phase temperature coefficient is not more than $5\times10^{-6}$/°C.

The phase temperature coefficient given by Equation 4 can be either positive or negative. Therefore, the conditions of the space factor of the insulator which make the absolute value of the phase temperature coefficient not more than $5\times10^{-6}$/°C. can be represented by the following Equation 6:

$$Rmin \lesssim R \lesssim Rmax. \tag{6}$$

In this connection, $$\frac{1}{Rmin} = -(\epsilon_0 - 1) + \tag{7}$$

-continued $$\frac{\epsilon_0}{2}\,\frac{\frac{1}{\epsilon_0}\frac{\partial\epsilon_0}{\partial T} + \left(1-\frac{1}{\epsilon_0}\right)\left[\alpha_0 - \alpha_1\frac{1+(\alpha_2/\alpha_1)(d_2/d_1)}{1+(d_2/d_1)}\right]}{5\times10^{-6} - \alpha_1\frac{1+(\alpha_2/\alpha_1)(S_2E_2/S_1E_1)}{1+(S_2E_2/S_1E_1)}}$$

$$\frac{1}{Rmax} = -(\epsilon_0 - 1) -$$

$$\frac{\epsilon_0}{2}\,\frac{\frac{1}{\epsilon_0}\frac{\partial\epsilon_0}{\partial T} + \left(1-\frac{1}{\epsilon_0}\right)\left[\alpha_0 - \alpha_1\frac{1+(\alpha_2/\alpha_1)(d_2/d_1)}{1+(d_2/d_1)}\right]}{5\times10^{-6} + \alpha_1\frac{1+(\alpha_2/\alpha_1)(S_2E_2/S_1E_1)}{1+(S_2E_2/S_1E_1)}}$$

where:

$S_1$: the cross-sectional area of the inner conductor,
$S_2$: the cross-sectional area of the outer conductor,
$E_1$: the Young's modulus of the material of the inner conductor,
$E_2$: the Young's modulus of the material of the outer conductor,
$\alpha_0$: the coefficient of linear expansion of the insulator material,
$\alpha_1$: the coefficient of linear expansion of the material of the inner conductor,
$\alpha_2$: the coefficient of linear expansion of the material of the outer conductor,
$d_1$: the outside diameter of the inner conductor,
$d_2$: the inside diameter of the outer conductor,
$\epsilon_0$: the dielectric constant of the insulator, and
T: the ambient temperature.

Next, a specific example of a phase stabilization type coaxial cable according to the invention will be described with reference to FIG. 1 and FIG. 2. The coaxial cable, as shown in FIG. 1, has an inner conductor 1 which is preferably a soft aluminum wire having an outside diameter $d_1$ of 8.0 mm and an outer conductor 3 which is a soft aluminum pipe with an inside diameter $d_2$ of 19.5 mm. The inner and outer conductors 1 and 3 are supported coaxially by an insulator which is produced by the following technique. A spiral rib 2 of width w is formed on the inner conductor 1 by direct extrusion molding of polyethylene and the spiral rib 2 is welded to an outer pipe 2′ of polyethylene having a thickness t. Table 1 below indicates the data of materials which were used to manufacture the coaxial cable.

TABLE 1

| | Coefficient of linear expansion | Temperature coefficient |
|---|---|---|
| Insulator (polyethylene) | $\alpha_0 = 2.0\times10^{-4}$/°C. | $\frac{1}{\epsilon_0}\frac{\partial\epsilon_0}{\partial T} = -2.8\times10^{-4}$/°C. |
| Inner conductor (aluminum wire) | $\alpha_1 = 2.3\times10^{-5}$/°C. | — |
| Outer conductor (aluminum pipe) | $\alpha_2 = 2.3\times10^{-5}$/°C. | — |

Figure 2:
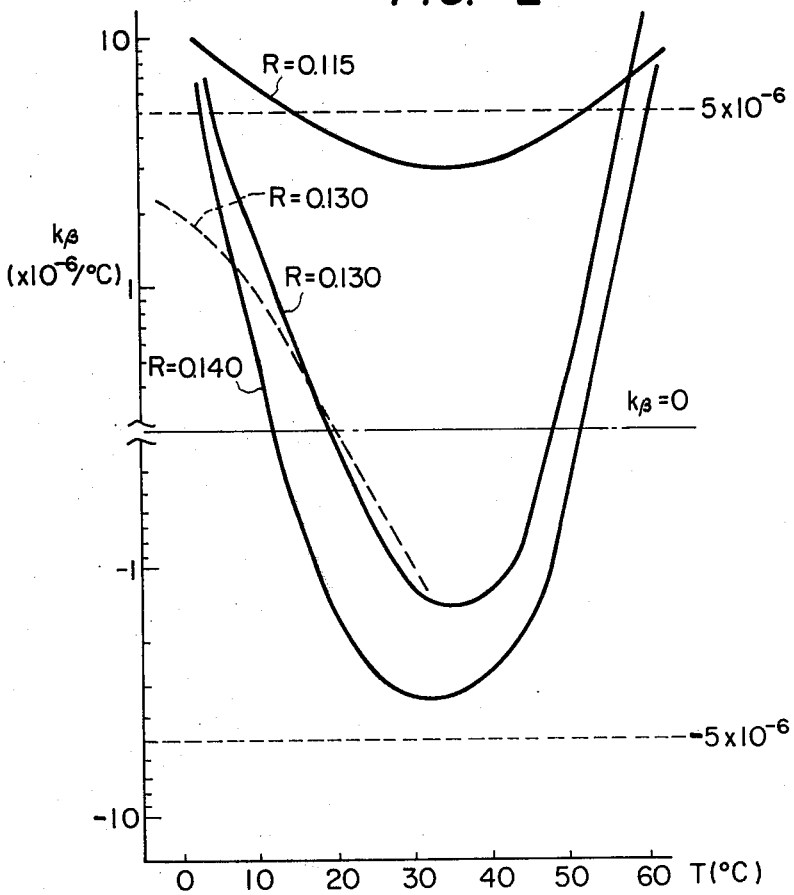
FIG. 2 is a graphical representation indicating relations between phase temperature coefficient $k_\beta$ and temperature T with space factor R as variable.

FIG. 2 indicates the temperature characteristics of the phase temperature coefficient $k_\beta$ of coaxial cables having an impedance of 50Ω which were manufactured with the materials indicated in Table 1 with different space factors R. As is clear from FIG. 2, when the space factor is of the order of 0.115, the phase temperature coefficient does not become zero. However, it remains below $5\times10^{-6}$/°C. in the temperature range of 15° to 55° C. When the space factor is 0.13 to 0.14, the phase temperature coefficient approaches zero at two temperatures, namely at about 15° C. and at about 50° C. In both cases, the phase temperature coefficient has a value less than $5\times10^{-6}$/°C. over a wide temperature range of more than 50° C. The curvatures shown by solid lines in FIG. 2 represent the relationship between phase temperature coefficient and temperature in the coaxial cables whose internal space defined between the insulators is in communication with atmosphere having relative humidity of 60%. On the other hand, a curvature shown by a broken line in FIG. 2 shows the relationship in a coaxial cable having space factor of 0.13, wherein drying air is confined in the internal space at the absolute pressure of 1.5 kg/cm$^2$ at the temperature of 15° C. In this case, since the humidity and confined gas pressure can be maintained constant, the phase temperature coefficient is further reduced, and a more stabilized coaxial cable is obtainable. As a condition to make the absolute value of the phase temperature coefficient less than $5\times10^{-6}$/°C., the range of space factor obtained from the above-described equations is from 0.10 to 0.16.

Thus, the phase temperature variation and the stable temperature range can be finely controlled by adjusting the space factor of the insulator. It goes without saying that completely the same results were obtained from 75Ω coaxial cables.

In the above-described coaxial cable, the insulator has a structure which is obtained by direct extrusion molding and therefore no internal stress remains in the spiral rib. The spiral rib is welded to the outer pipe and the outer wall of the outer pipe is in close contact with the inner wall of the pipe-shaped outer conductor. Therefore, the structure of the coaxial cable is maintained unchanged even if the ambient temperature changes. Furthermore, bonding the outer wall of the outer pipe to the inner wall of the pipe-shaped outer conductor can remarkably improve the thermal stability of the coaxial cable. In addition, for a coaxial cable in which drying gas is sealed, the structure of the coaxial cable is maintained stable against the pressure of the gas even if the gas pressure is varied.

What is claimed is:

1. An air dielectric coaxial cable comprising: an inner conductor, and outer conductor, and an insulator disposed between said inner and outer conductors in which the space factor R of said insulator is such that: Rmin<R<Rmax, where:

$$\frac{1}{R_{min}} = -(\epsilon_0 - 1) + \frac{\epsilon_0}{2}\,\frac{\frac{1}{\epsilon_0}\frac{\partial\epsilon_0}{\partial T} + \left(1 - \frac{1}{\epsilon_0}\right)\left[\alpha_0 - \alpha_1\frac{1 + (\alpha_2/\alpha_1)(d_2/d_1)}{1 + (d_2/d_1)}\right]}{5\times10^{-6} - \alpha_1\frac{1 + (\alpha_2/\alpha_1)(S_2E_2/S_1E_1)}{1 + (S_2E_2/S_1E_1)}}$$

and $$\frac{1}{R_{max}} = -(\epsilon_0 - 1) - \frac{\epsilon_0}{2}\,\frac{\frac{1}{\epsilon_0}\frac{\partial\epsilon_0}{\partial T} + \left(1 - \frac{1}{\epsilon_0}\right)\left[\alpha_0 - \alpha_1\frac{1 + (\alpha_2/\alpha_1)(d_2/d_1)}{1 + (d_2/d)}\right]}{5\times10^{-6} + \alpha_1\frac{1 + (\alpha_2/\alpha_1)(S_2E_2/S_1E_1)}{1 + (S_2E_2/S_1E_1)}}$$

where:

$S_1$: the cross-sectional area of said inner conductor, $S_2$: the cross-sectional area of said outer conductor, $E_1$: the Young's modulus of a material forming said inner conductor, $E_2$: the Young's modulus of a material forming said outer conductor, $\alpha_0$: the coefficient of linear expansion of the insulator material, $\alpha_1$: the coefficient of linear expansion of said material forming said inner conductor, $\alpha_2$: the coefficient of linear expansion of said material forming said outer conductor, $d_1$: the outside diameter of said inner conductor, $d_2$: the inside diameter of said outer conductor, $\epsilon_0$: the dielectric constant of said insulator, and T: the ambient temperature.

2. The air dielectric coaxial cable as claimed in claim 1 in which said insulator is formed by welding a spiral rib provided on the outer wall of said inner conductor to an outer pipe which covers said spiral rib, said spiral rib and outer pipe being made of synthetic resin, and said outer conductor being provided on the outer wall of said outer pipe in such a manner that the inner wall of said outer conductor is in close contact with the outer wall of said outer pipe.

3. The air dielectric coaxial cable as claimed in either claim 1 or 2 in which said outer conductor is a metal pipe having a smooth inner wall, said smooth inner wall of said outer conductor being bonded to the outer wall of said outer pipe of said insulator to form an integral unit.

4. The air dielectric coaxial cable as claimed in either claim 1 or 2 wherein said inner and outer conductors comprise aluminum and said insulator comprises polyethylene.

* * * * *